United States Patent [19]

Moyer, Jr.

[11] 4,244,813

[45] * Jan. 13, 1981

[54] METHOD OF INCREASING FINE COAL FILTRATION EFFICIENCY

[75] Inventor: William H. Moyer, Jr., Coopersburg, Pa.

[73] Assignee: Bethlehem Steel Corporation, Bethlehem, Pa.

[ * ] Notice: The portion of the term of this patent subsequent to Nov. 20, 1996, has been disclaimed.

[21] Appl. No.: 64,686

[22] Filed: Aug. 8, 1979

Related U.S. Application Data

[63] Continuation of Ser. No. 881,977, Feb. 27, 1978, Pat. No. 4,175,035.

[51] Int. Cl.[3] ..... B03D 1/02

[52] U.S. Cl. ..... 209/5; 209/10; 210/704; 210/711

[58] Field of Search ..... 209/5, 10, 12, 166, 209/214; 210/13, 44, 73 R, 74, 83, 221 P

[56] References Cited

U.S. PATENT DOCUMENTS

| | | | |
|---|---|---|---|
| 1,938,894 | 12/1933 | Darby et al. | 210/55 |
| 2,317,139 | 4/1943 | Frantz | 210/44 |
| 2,411,288 | 11/1946 | Morse | 209/164 |
| 2,656,118 | 10/1953 | Chelminski | 209/10 |
| 2,713,026 | 7/1955 | Kelly et al. | 210/3 |
| 2,876,863 | 3/1959 | Kovari | 183/114 |
| 2,970,689 | 2/1961 | Chang et al. | 209/12 |
| 3,043,426 | 7/1962 | Noone | 209/12 |
| 3,233,731 | 2/1966 | Nailler | 209/12 |
| 3,579,442 | 5/1971 | Gerwig | 210/74 |
| 3,696,923 | 10/1972 | Miller | 210/73 R |
| 4,065,385 | 12/1977 | Aktay et al. | 210/44 |
| 4,175,035 | 11/1979 | Moyer, Jr. | 210/73 R |

OTHER PUBLICATIONS

Miller, K. J., "#8239 Coal-Pyrite Flotation in Concentrated Pulp," U.S. Dept. of Interior, 1977, pp. 1-12.

*Perry's Chemical Engineers Handbook*, 3rd ed., 195, p. 1091.

*Primary Examiner*—Peter A. Hruskoci

*Attorney, Agent, or Firm*—Joseph J. O'Keefe; Charles A. Wilkinson

[57] ABSTRACT

Fine coals suspended in a coal flotation froth are more efficiently filtered when the flotation froth is subjected to a thickening operation prior to filtration. The thickening operation is accomplished by the use of a clarifier or thickener.

4 Claims, 5 Drawing Figures

RAW COAL
11
13
1/4" SCREEN
+
19
21
HEAVY MEDIUM BATH
21b
SCREEN
25
REFUSE
SCREEN
COAL
23
21a
15
−
17
28 MESH SCREEN
27
+
29
HEAVY MEDIUM CYCLONES
29b
SCREEN
33
REFUSE
SCREEN
35
−
31
37
HYDROCYCLONES
OF
39
41
SIEVE BEND
47
+
51
CENTRIFUGE
COAL 53
49
−
U F
43
55
FLOTATION
FROTH 57
61
THICKENER
62
REFUSE 45
REFUSE 59
64
67
63
FILTER
65
69
DRYER
COAL 71

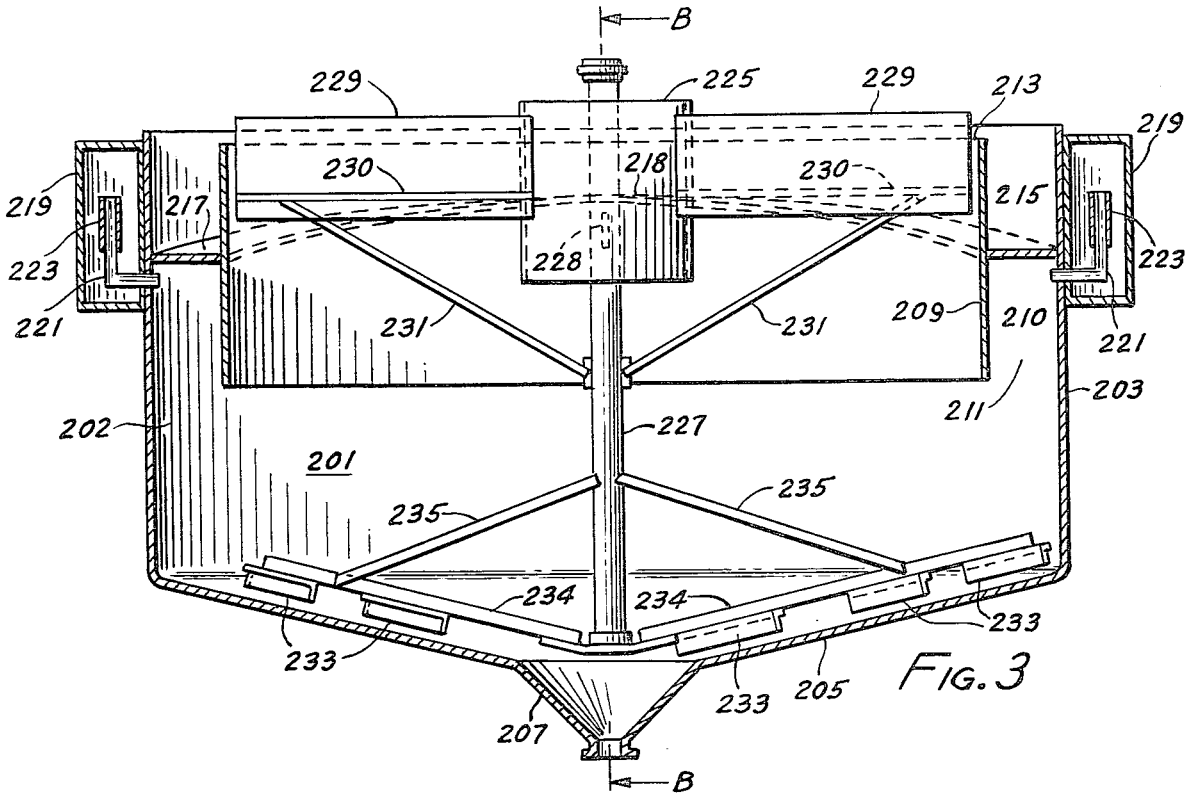
FIG. 3
FIG. 5
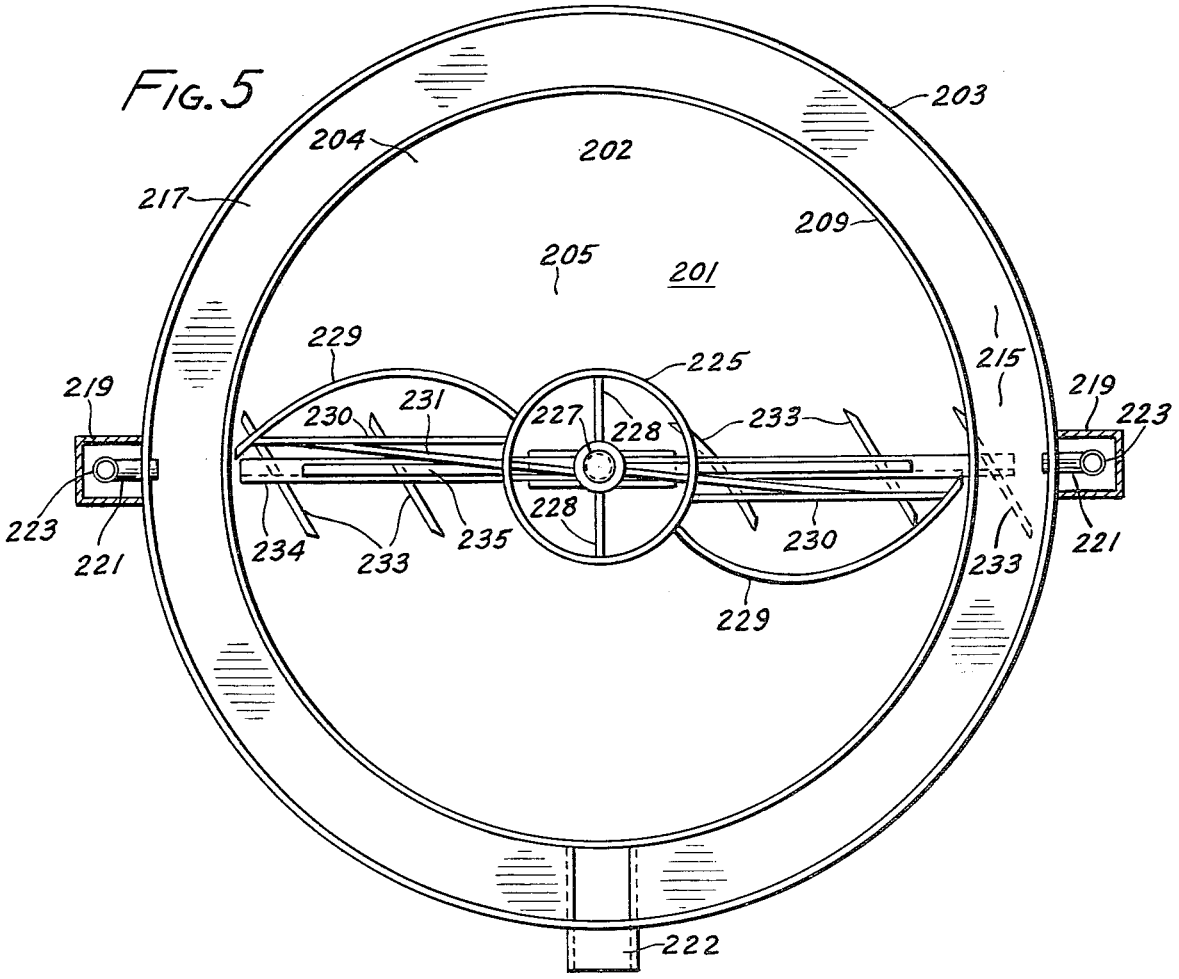

METHOD OF INCREASING FINE COAL FILTRATION EFFICIENCY

This is a continuation, of application Ser. No. 881,977, filed Feb. 27, 1978, now U.S. Pat. No. 4,175,035

BACKGROUND OF THE INVENTION

Raw coal, as it is taken from a mine, consists of lumps and particles of coal which differ both in size and degree of purity. Before such coal may be shipped to a consumer it must be crushed and sized and must meet specified standards of purity in order that it be fit both for shipping and for its intended use. Specifically, the coal must often be separated both from refuse, i.e., pyrites, slate, clay, etc., and from water, and other liquids, used to separate such refuse.

To effect such separation, the raw coal is frequently subjected to a crushing operation and then to a series of screening operations which pass the oversizes, i.e., the coal that does not pass through the screens, to jigs, heavy medium cyclones or hydrocyclones or other appropriate apparatus where refuse is removed.

The coal particles which pass through all screening operations, i.e., the coal undersizes, are designated "fines" and are typically on the order of minus sixty-five mesh. These fines represent a significant percentage of the coal mined and, therefore, the overall economics of the mining operation are dependent upon an efficient separation and recovery of these fines from their impurities.

Conventional methods for the purification and recovery of fines comprise routing an aqueous slurry of these fines to a flotation cell in which the slurry is treated with an organic reagent such as, for example, methyl isobutyl carbinol or 2-ethylisohexanol. These reagents, by virtue of their affinity for carbonaceous surfaces, coat the coal particles, while leaving the non-carbonaceous particles of refuse unchanged. The flotation bath in which such coating is effected is vigorously agitated by conventional stirring means and by constant aeration. As a result of this agitation and aeration, the alchol-coated coal fines tend to adhere to the air bubbles and rise to the surface of the bath, forming a so-called flotation froth. At the same time, the uncoated refuse particles tend to remain in suspension in the flotation bath and are withdrawn therefrom and discarded. With sixty-five mesh coal, the flotation froth may typically contain perhaps 15% coal particles and as much as 20% of coal particles by weight, the exact percentage being dependent on particle size, shape and density, type of flotation machine and manner of operation.

This flotation froth is continuously removed from the surface of the bath and vacuum filtered in order to dewater the coal. The fine coal is then removed from the filter and either used as is or recombined with the larger coal sizes separated by prior screening and processing steps.

The use of these conventional techniques results in acceptable purification of the fine coal in the flotation step itself. However, the filtration step has been less than satisfactory due to at least two limiting factors directly resulting from the sheer amount of water contained in the flotation froth.

The first limiting factor arises from the fact that virtually all filters are limited in the gross volume of filterable solution they can handle per unit time by the size of the filter. Thus one consequence of the high water to coal weight ratio in conventional flotation froths is that the sheer volume of froth containing a given amount of water may exceed the filter's physical capacity or volume and thereby limit the hourly volume of froth which can be filtered. In other words, although a given filter may be capable of handling the amount of water contained in a given amount of flotation froth, the sheer volume of froth containing water may be too great for the filter to handle efficiently, or even at all. As a result, the overall rate of coal processing may be seriously limited by the filtration step.

The second limiting factor in the conventional process is the low yields of coal per unit time. This low isolation rate (expressed, for example, in pounds of coal isolated per hour) is directly attributable to the relatively low percentage of coal present in any given volume of conventional flotation froth.

It is important in many filters, furthermore, particularly in drum or disk type vacuum filters, for the medium being filtered to contain sufficient solids to initially coat the filter element in order to establish a differential pressure between the downstream side of the filter and the upstream side. If, for example, a drum or disk type filter is presented with a froth containing only a little particulate material such as fine coal, the surface of the filter in the absence of a coating of particulate will remain so porous that insufficient pressure difference between one side of the filter medium and the other will be established to conduct any substantial filtering at all. Thus in those cases in which the froth volume compared to the solids content of the froth is very large initiation of filtering may be delayed for a finite period as the solids build up on the filter surface thus delaying the initiation of efficient filtering and possibly allowing more fine solids than usual to pass through the filtering medium or filter cloth.

In order to avoid these difficulties a coarser coal product from a various separation step has often been combined with the froth, or flotation product, prior to filtering to increase the percentage of coal in the flotation product and increase the efficiency of filtering. The combination of the prior coarser coal, for example, coal having a particle size greater than 65 mesh, with the flotation coal product of 65 mesh or less naturally provides a mixed coal size which may, or may not, be desirable depending upon circumstances. A more serious problem arises, however, when the flotation product must be thermally dried after filtering, but prior to use. Fine coal particles of about 65 mesh or less have a large aggregate surface area and tend to retain a large amount of moisture. A fairly large amount of fuel is necessary to generate the heat values to remove this moisture. Under these circumstances it is inefficient to mix a coarser coal product with the fine coal flotation product and thermally dry the mixed coal product. The coarse coal does not normally retain sufficient moisture to require thermal drying and thus adds a significant amount of bulk to the mixed product, all of which must be heated, without adding moisture which requires removal. The efficiency of the drying operation is thus substantially decreased.

It has been customary under somewhat similar circumstances in the filtering of mineral flotation products, for example, mineral ores and the like, to thicken the flotation product by the use of a thickener or clarifier. In these systems the flotation product is conveyed to a thickener where is is retained on the surface of the liquid body in the thickener until the froth breaks down and the mineral particles settle to the bottom of the thickener. The underflow is then conveyed to a suitable filter. Sometimes sprays are used to accelerate decomposition of the flotation foam or froth on the surface of the thickener.

While flotation followed by thickening in a thickener, or settling apparatus, has been successfully used in the treatment of mineral ores, it has not proven satisfactory in the treatment of coal. The mineral particles in an ore flotation froth product have a higher specific gravity than coal particles and are less resistant to wetting than coal froth solids. Consequently, while mineral particles are readily released from a flotation froth, coal solids in a flotation froth product are not readily released from the froth in a conventional thickener even with auxiliary spraying. The froth persists and only a portion of the fine coal product will settle to the bottom of the thickener in a condition for filtering. In the case of coal, once the coal has been floated it is almost totally impossible without chemical treatment to sufficiently wet all the floated coal particles to release the coal from the froth so that a conventional thickener can be used to prepare the flotation product for efficient filtering. Some amount of coal will always remain attached to the air bubbles and remain on the surface of the thickening vessel.

It would thus be desirable to decrease the volume of coal flotation froth product prior to filtration. It would, furthermore, be desirable to decrease such volume while increasing the percentages of coal particles per unit volume of froth product in order that fine coals may be more rapidly isolated therefrom.

SUMMARY OF THE INVENTION

I have discovered that both of these desirable goals may be accomplished by subjecting fine coal flotation froths to a pre-filtration thickening step wherein the weight ratio of coal to water in the products is increased. Specifically, my process treats fine coal flotation froths in a modified conventional thickener whereby a portion of the froth is physically decomposed, i.e., a portion of the bubbles contained in the froth are caused to burst or coalesce. This decomposition results in the draining of a significant portion of the water contained in the original froth, thereby increasing the coal to water weight percent, i.e., thickening the froth.

In addition to decreasing the water content of the froth, the thickening operation causes a portion of the suspended coal particles to separate from the froth. The major portion of this separated coal settles to the bottom of the thickening apparatus where it may be collected and recombined with the thickened froth prior to filtration to yield a froth product with an even higher solids content.

I have found that a froth thickened in accordance with my invention results in both an increase in the overall filtration rate and in an increase in the rate of recovery of coal solids from the fine coal flotation froth product per unit time. Furthermore, where the volume of the non-thickened foam or flotation product compared to the solids content of fine coal which is contained in the foam is very large, use of the thickening operation also increases the efficiency of filtering, i.e., the solids recovery, itself, due to accelerated coating of the filter surface with fine particles which increase the filter separation efficiency.

In a preferred arrangement the flotation froth is passed from the flotation tanks to a thickener where the froth floats upon the surface of a body of fluid contained in the thickener. The residence time in the thickener is sufficient so that significant water contained in the froth drains from the froth into the underlying liquid and a portion of the coal fines in the froth settle to the bottom of the thickener. The remaining thickened froth is then pushed from the surface of the liquid over the edge of the thickener, preferably combined with underflow solids, and transported to the filter. Water as an effluent is drawn off at an intermediate point and can be returned to process.

BRIEF DESCRIPTION OF THE DRAWINGS

FIG. 3 is a vertical cross-section of the thickener preferably used in the process of the invention.

FIG. 5 is a top view of the thickener used in my process.

DESCRIPTION OF THE PREFERRED EMBODIMENT

A complete understanding of the invention may be gained by those skilled in the art from the following discussion with reference to the drawings.

Figure 1:
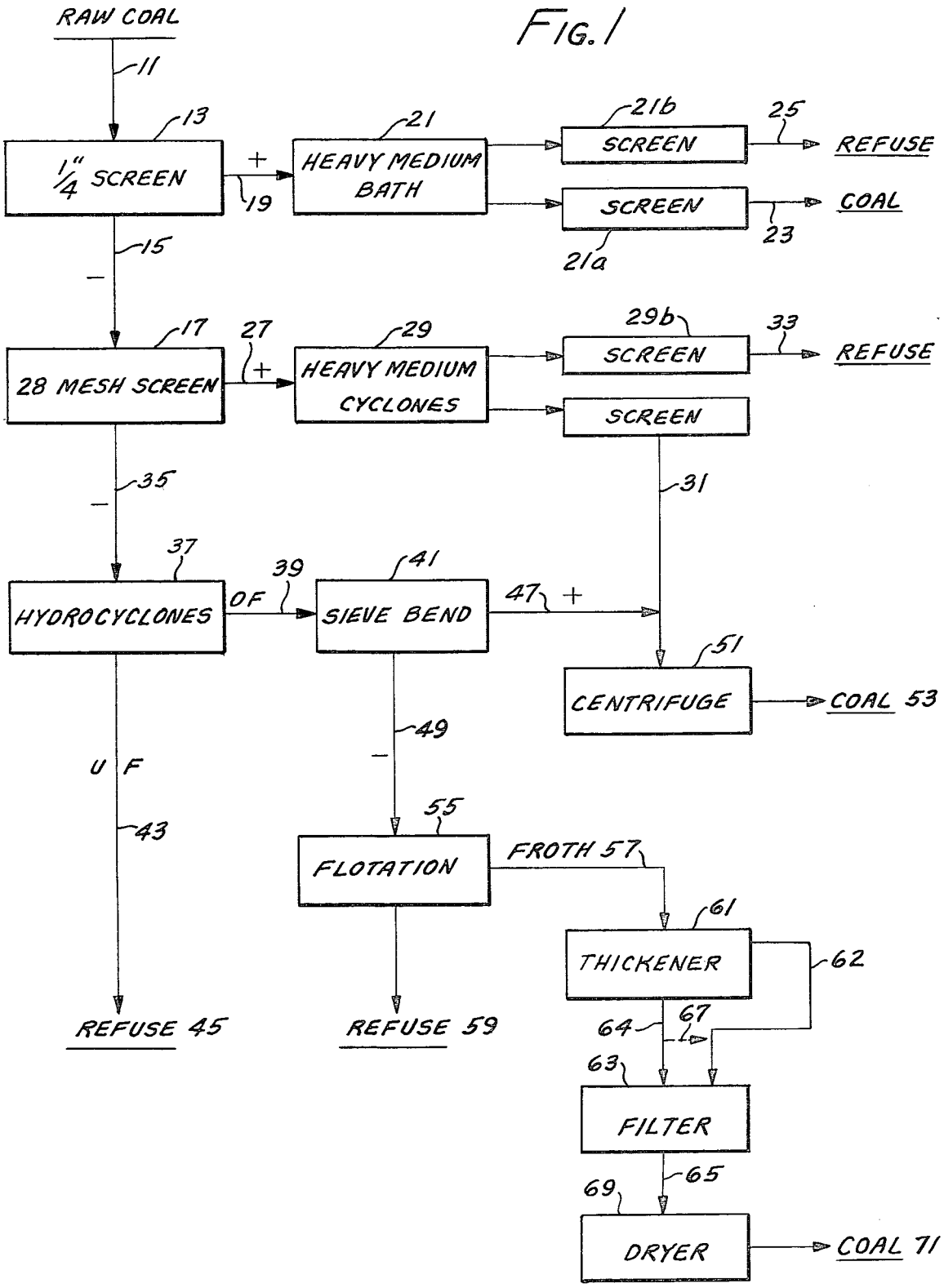
FIG. 1 is a block type flow diagram depicting the various steps in a typical raw coal treatment process utilizing the present invention.

Referring to FIG. 1 there is shown a block flow diagram of a coal treatment operation or plant wherein raw coal 11 received from the mine or from crushers, not shown, passes to a screening station or operation 13, which may use a ¼ inch screen, where the coarse fines 15 are removed and passed to a second screening station 17. The coarse coal screen product 19 from the screening operation 13 may be passed to a heavy medium separation bath 21 for separation into a coarse coal product 23 and a refuse product 25 containing slate, rock, clay and other gangue material which is discarded. The coarse coal product 23 can be used as is, or reground and used, or retreated. Both the coarse coal 23 and the refuse 25 are shown treated in screen drain and wash stations 21*a* and 21*b* as shown after passage through the heavy medium bath 21 in order to separate the heavy medium from the two products.

The coarse fines 15 are screened in the second screening station 17, which may use a 28 mesh screen, to produce a second coarse coal screen product 27 which may likewise be passed to heavy medium cyclones 29 which in turn produce a coarse or medium coarse coal product 31 and a refuse product 33. The two products 31 and 33 are separated from the medium used in cyclones 29 by the use of drain and wash screens 29*a* and 29*b*.

The fines 35 from the screening operation 17 are passed to hydrocyclones 37 where the fine coal particles are separated into an overflow stream 39 which is passed to a conventional sievebend 41 and an underflow stream 43 which is passed to refuse 45. The overflow stream 39 which contains most of the coal is separated on the sievebend 41 into a medium coal product 47 and a fine coal product 49. The medium coal product 47 is shown combined with the medium coarse coal product 31 and passed to a centrifuge operation 51 where the final medium coal product 53 is dewatered.

Figure 4:
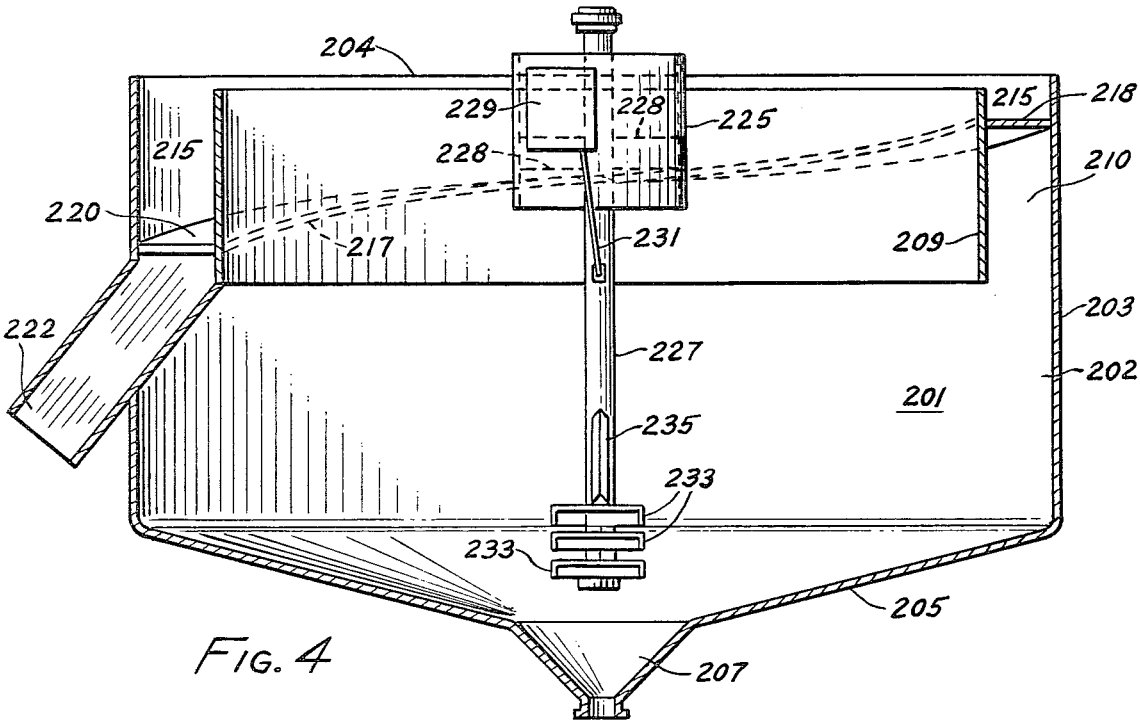
FIG. 4 is a second vertical cross-section of the thickener used in the process along the line B—B of FIG. 3 taken at approximate right angles to FIG. 3.

The fine coal product 49, which contains contaminating substances, is passed to a flotation operation 55 where a fine coal froth product 57, which may contain coal particles of minus 65 mesh size, is floated from a denser refuse product 59 in a conventional manner and the float or froth product is passed in accordance with the present invention to a thickening operation in a thickener 61 which is shown in more detail in FIGS. 3, 4 and 5 herein. In accordance with the invention the flotation or froth product 57 is thickened in the thickener 61 by allowing a residence time in the thickener 61 sufficient to allow water to drain from the froth into the body of liquid held in the thickener 61. The thickened froth or densified foam product 62 is then passed to a filter 63 by sweeping the densified foam from the surface of the body of liquid in the thickener with suitable sweep arms and conveying the thickened or densified foam to the filter. As the water drains from the foam product in the thickener some of the floated coal is released from the foam and drops to the bottom of the thickener. This coal is removed from the bottom of the thickener in a normal fashion as a slurry 64 and is also passed to the filter 63 and after filtration enters the filtered fine coal product 65. More preferably the coal product from the bottom of the thickener 61 is mixed uniformly with the froth flotation product prior to filtration as shown by the dotted line 67 to further thicken or increase the percentage of fine coal in the froth prior to passage of the froth product onto the filter increasing the efficiency or capacity of the filtering operation. This is shown more clearly in FIG. 2. The heavy refuse material 59 is discharged from the bottom of the flotation apparatus and passed to waste.

The filtered coal product 65 is passed to a thermal dryer apparatus 69 for removal of residual moisture from the final fine coal product 71. Alternatively the filtered fine coal product 65 can be used if desired without drying. However, the fine coal has a considerable amount of surface area and even after filtering tends to have a considerable amount of water associated with it. Thermal drying is thus usually necessary to obtain a satisfactory final fine coal product. Prior to the present invention it has usually been necessary in order to effect satisfactory filtering of the flotation product to mix some of the medium to coarse coal product 31 or medium coal product 47 with the flotation product or fine coal froth product 57 in order to densify the froth product sufficiently to attain an efficient filtering operation. The medium coal product, however, is more effectively dewatered by centrifuging and the medium coal product merely adds bulk in the thermal drying cycle if added to the flotation froth product without a commensurate amount of water which might require thermal drying.

Figure 2:
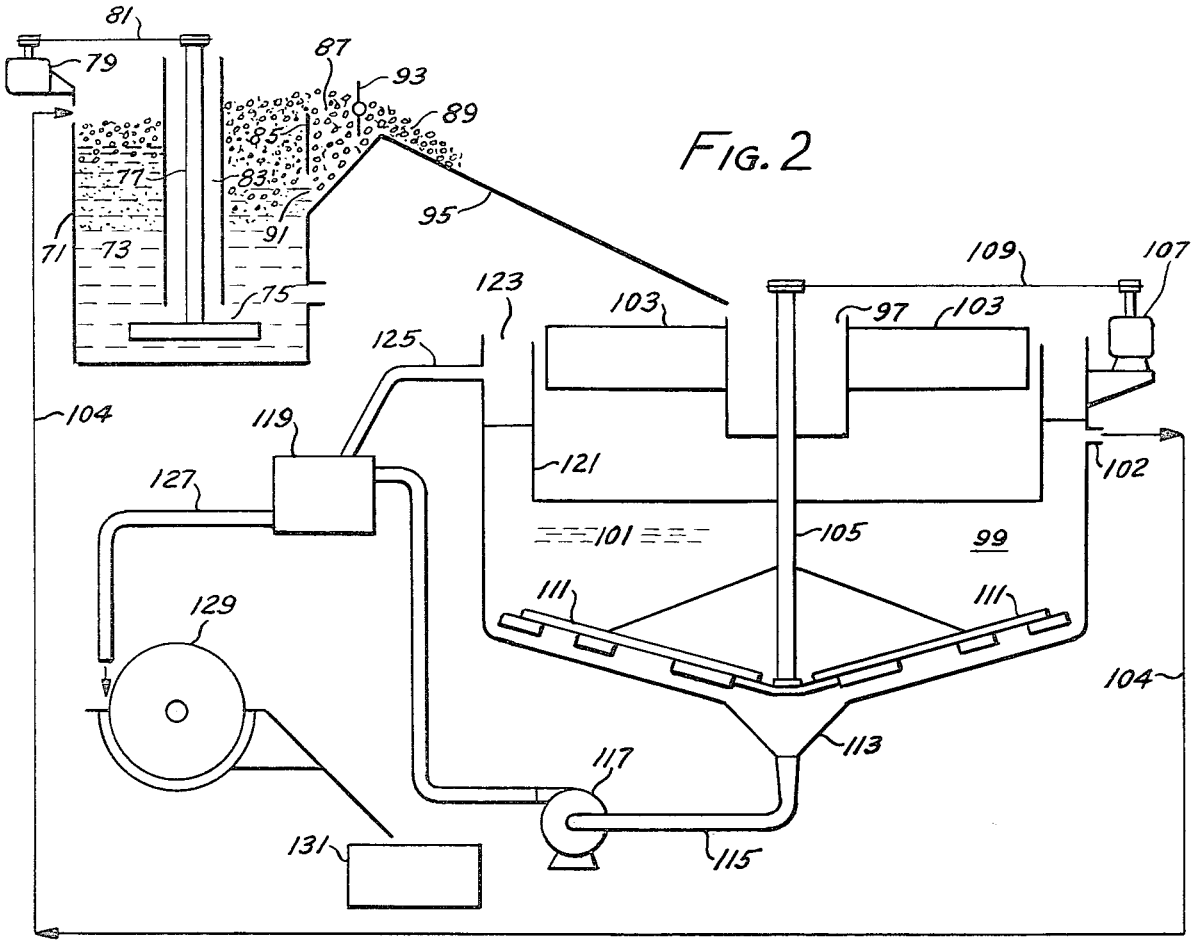
FIG. 2 is a schematic type diagram showing the treatment of coal fines in a circuit including a flotation chamber, thickener and filter in accordance with the invention.

FIG. 2 shows schematically the combination of the flotation, thickening and filtering steps of the invention in more detail. In FIG. 2 is shown a conventional flotation apparatus 71 into which "raw coal" in the form of a fine coal product from a prior screening operation such as shown in FIG. 1, or from some other treatment apparatus, is passed. The fine coal is deposited into the top of the flotation apparatus in any suitable manner and mixes with a body of liquid in the flotation chamber 73. A series of spinning blades or agitators 75 at the bottom of the apparatus are driven through a central shaft 77 by a motor 79 and drive belt 81 at a high rate of speed. Air is drawn down the central well 83 of the apparatus and is intimately mixed with the liquid within the apparatus as fine bubbles which float to the surface of the liquid body 73 attaching to fine coal particles as the bubbles rise. A suitable flotation agent is added to the liquid to enhance the attraction between the bubbles and the coal particles or to cause the bubbles to adhere more strongly to the coal while rejecting the remaining refuse material, all as well known in the art of flotation treatment. The bubbles and attached fine coal particles collect on the surface of the flotation chamber as a froth product and overflow the baffle 85 into the residence chamber 87 where some densification or thickening of the froth product 89 occurs before the froth product is forced from the residence chamber 87 by the rotating paddle arrangement 93 and passed along the chute 95 to the central feed chamber 97 of a thickener 99. Water draining from the froth product 89 passes back into the main body of liquid 73 in the flotation apparatus through the opening 91 between the baffle 85 and the side of the flotation chamber 73.

The froth product 89 which enters the central feed chamber 97 of the thickening apparatus of thickener 99 overflows out the bottom of the feed chamber 97 into the main body of the thickener where it floats on the surface of the body of liquid 101 contained in the thickening apparatus. The froth product 89 floats on the surface of the liquid 101 for a period designed to be sufficient to allow a significant amount of water to drain from the foam product 89 so that the foam is thickened.

The water which drains from the foam product is removed from the thickening apparatus through draw-off tube 102 and returned to the process, i.e., usually the flotation chamber 71, for reuse. A suitable recycle line for the water is indicated as line 104 in FIG. 2. The fine coal particles suspended in the recycled water are largely removed during the next passage through the flotation-thickening process so that the quantity of fine coal particles in the recycle water does not significantly increase with time.

The foam is pushed from the surface of the liquid 101 by a series of spiral blades 103, more clearly shown in subsequent views in FIGS. 3, 4 and 5. The spiral blades are supported from and rotated by shaft 105 which is in turn rotated by a motor 107 and drive belt 109. The shaft 105 also supports and rotates scraper blades 111 at the bottom of the thickener 99 which serve to scrape coal solids which drop to the bottom of the thickener and urge them toward the sump 113 from which they are pumped as a slurry via conduit 115 and pump 117 to mixing chamber 119 where the coal slurry is preferably mixed evenly with froth product. The froth product is expelled over side baffle 121 by the spiral rotating blades 103 into peripheral trough or launder 123 from which the froth product flows through conduit 125 to the mixing chamber 119. The combined mixture of coal slurry and thickened froth, or densified foam, product then passes from the mixing chamber 119 through conduit 127 to the rotating filter 129.

The mixing chamber 119 may consist of a small enclosed space into which both coal underflow and densified froth overflow are passed. Mixing occurs essentially upon contact and retention within the mixing chamber may be a matter of seconds. Alternatively, the coal slurry may be merely passed into the conduit along or through which the froth product is conducted.

The froth product, which has been thickened, or densified, in the thickener 99 by allowing a residence time sufficient to allow some of the moisture of the froth product to drain from the froth so that the percentage of coal to volume of froth bubbles is increased, and which preferably has also been mixed with coal slurry from the bottom of the thickener to further increase the relative percentage of coal to froth volume, filters efficiently upon the filter with an increased filter rate as compared to the filter rate of unthickened froth product. While it is preferred to mix the coal slurry from the bottom of the thickener with the already thickened, or densified, froth product in order to further increase the percentage of coal fines in the froth product prior to filtering, it is also possible to either pass the coal slurry directly to the filter 129 or alternatively to pass it to a second filter or even to merely allow it to drain and dry naturally. In either case the thickened froth product, which must, as a practical matter, be filtered somewhere along the way, is filtered more efficiently and at an increased rate than would otherwise be the case. The filtered fine coal product is discharged from the filter into container 131.

The flotation foam derived from the flotation apparatus 71 will usually contain not more than about 18 to 20% solids by weight while after densification or thickening the flotation froth will preferably contain more than about 30% solids by weight, although it may contain from 25 tpo 30% solids. Naturally any significant amount of thickening is beneficial to filtering efficiency. The foam, which initially has a consistency of stiff soap suds, after densification becomes essentially self supporting and very stiff and heavy, although it will still flow.

A preferred construction of a flotation thickener for use in the present invention in shown in FIGS. 3, 4 and 5 and described below.

Referring to FIGS. 3, 4 and 5, thickener, 201, is comprised of an upright cylindrical tank 202 having an outer wall 203, which wall has an outer surface and an inner surface, a generally open top 204 and a bottom 205. The bottom 205 tapers toward the central axis of the tank and forms an underflow discharge port 207. A cylindrical baffle plate 209 concentric with, and in spaced relationship to, the outer wall 203 is provided in the upper end of the tank and is attached to the tak by a concentric structural plate 217. The annular space between said baffle and said wall has an open lower end 211 and an open upper end 213. The upper end of the baffle 209 is positioned below the upper end of the outer wall 203 of the tank 202. A quiescent zone 210 is defined by the lower portion of the baffle, the structural plate 217 and the opposing surface of the wall 203. A peripheral trough or launder 215 is formed by the upper portion of baffle plate 209, the inner surface of the upper end of the tank wall 203, and structural plate 217. This peripheral launder 215 extends 360° around the inner surface of the wall 203 and is characterized by a descending pitch in the structural plate 217 from a high point 218 to a low point 220, 180° away. See FIG. 4. At the low point 220, a froth launder discharge outlet 222 is connected to suitable froth pumping means, not shown. Alternatively, a plurality of individual peripheral launders may be formed by baffle 209, wall 203 and individual structural plates 217 together with suitable end plates. In this alternative constuction each individual launder is equipped with a froth launder discharge outlet analogous to outlet 222 which, in turn, communicates with pumping means, not shown in FIGS. 3, 4 and 5. See FIG. 2.

Waste water boxes 219 are attached to the outer surface of wall 203 at regularly spaced intervals. Effluent ports 221, which connect the interior of thickener tank quiescent zone 210 with the interior of waste water boxes 219, are equipped with adjustable sleeve 223. Each waste water box is, in addition, equipped with a drainage means, not shown, whereby water leaving tank 202 through effluent port 221, overflowing adjustable sleeve 223 and entering waste water box 219 may be drained therefrom and disposed of or further treated as discussed below.

A cylindrical feed well 225 concentric with both the outer wall 203 and the baffle 209 and inside the baffle is provided in the tank 202. A rotatable shaft 227, which serves as both a mounting and driving means for rakes and scrapers in the thickener 202, is axially positioned and connected via suitable connecting means at the top to drive means, not shown. Cylindrical feed well 225 is spaced from and supported by rotatable shaft 227 through attachment struts 228. In the upper end of the tank, spiral skimming blades or skimmers 229 are mounted on feed well 225 and are stabilized by stiffeners 230 and skimmer supports 231 which, in turn, are attached to mounting and driving shaft 227. In the lower end of the tank, rakes 233 are mounted on the rake mountings 234 secured to shaft 227 and are stabilized by rake support means 235 also mounted on shaft 227. Both the spiral skimmers 229 and rake mountings 233 extend radially outwardly from the mounting and driving shafts 227.

In operation, a froth product, containing particles of fine coal from froth flotation cells in a coal preparation plant, is charged into feed well 225 of the tank. The froth tends to float on the water in the tank, and while it does so, a portion of the water in the froth product drains downwardly from the froth into the water in the tank carrying with it a portion of the coal in the froth, which coal subsequently settles to the bottom 205 of the tank 202. By such action, the froth remaining atop the bath is thickened.

Thickening can be defined as a decrease in the volume and water content of the foam with an accompanying increase in the percentage of solids contained in the remaining foam. Thickening results essentially from a decrease in the liquid contained in the walls of the bubbles of the foam. The liquid content may be decreased either through evaporation of the liquid from the surface of the foam or by draining of liquid from the bubble walls due to the downward pull of gravity. In either case the individual bubbles tend to become smaller or to burst when the walls contain insufficient liquid for the surface tension to maintain a cohesive bubble wall. Coalescence of bubbles due to rupture of the walls between bubbles leads to the formation of larger bubbles with an effectively smaller surface area per unit volume of gas enclosed. Thus, regardless of whether the individual bubbles become smaller as liquid is removed from their walls, or bigger as a result of consolidation or coalescence between bubbles as separating bubble walls rupture, the effective area of the bubble walls in the froth decreases. Since the coal particles adhere to the bubble walls, the decrease in the wall area effectively increases the concentration of coal particles per unit of wall area. This process effectively increases the solids content of the froth and thickens the froth. As the area of the walls decreases and the concentration of coal particles becomes greater some of the coal particles are crowded off and drop from the foam. Other coal particles are released as individual bubble walls are ruptured particularly around the periphery of the foam mass. The maintenance of a liquid body in contact with the lower periphery of the froth or foam encourages the drainage of liquid of similar composition from the bubble walls in the froth. Approximately one-third to one-half or even more of the coal particles remain attached to the densified foam at the surface of the thickener. The thickened or densified foam material has a consistence such that if cut or cleaved it will maintain its shape in a self supporting mass but is still not so stiff that it will not flow along or through a conduit of reasonable dimensions such as, for example, a four to six inch diameter conduit. It has been found to be very difficult if not impossible to release the remaining fine coal solids from the densified foam without the addition of special and expensive wetting agents.

The mounting and driving shaft 227 is continuously rotated by the drive means to continuously rotate both the spiral skimmers 229 and the rakes 233. The rotation of the spiral skimmers pushes the thickened froth product from atop the water in the tank, over the top of the baffle 213 and into peripheral launder 215. The froth product then flows down the peripheral launder incline to an outlet 222 at the low point of the launder from which it may be removed and routed either to the filter or to any suitable apparatus for preliminary recombination with the coal solids separated and collected as further described below.

As previously stated, during the thickening operation both water and particles of coal separate from the froth and mix with the underlying water layer. The water level in the thickener is stabilized by effluent port 221 and adjustable sleeve 223. By vertical adjustment of sleeve 223, the level of the liquid in the thickener may be varied over a limited range to accommodate different froth depths. Water in excess of this desired volume exits over the top of sleeve 223 into waste water boxes 219 and is removed therefrom. The water from the boxes may contain significant amounts of suspended fine coal particles, and it is therefore preferable from an efficiency view-point that such effluent water be returned to a prior step in the coal purification operation in order that this coal may be recovered. To this end, water may be used either as a carrier in the screening operations or may be returned to the prior flotation operation.

The heavier coal particles which have separated from the froth product sink to the bottom of the thickener tank where the rotation of rakes 233 moves the particles down the inclined bottom 205 toward underflow discharge 207, from which point pumping means, not shown, may route these solids to the previously mentioned apparatus for recombination with the thickened froth prior to filtration. Alternatively the collected solids may be passed to a dryer or the like prior to being used as a fine coal.

The use of a thickening operation as described results in the separation of three coal-containing components from a flotation froth product: (1) a thickened froth, (2) a water stream and (3) an underflow discharge. The coal particles contained in water stream (2) are smaller than the underflow discharge coal particles (3) which sink to the bottom of the thickener and the water can be recycled in the process.

In order to compare the filtration efficiency of froths as a function of the amount of coal solids per unit volume, comparative experiments were run in which approximately equal volumes of froth products containing increasing coal concentrations were subjected to a conventional filtration operation. Table I gives the results of such experiments.

TABLE I

COMPARATIVE FILTRATION TEST RESULTS*

| Test No. | 1 | 2 | 3 | 4 |
|---|---|---|---|---|
| Feed - Volume - cc | 2000 | 2000 | 2000 | 2000 |
| Feed - % Solids (By Weight) | 9.5 | 14.0 | 18.4 | 31.3 |
| Forming Time - Min. | 1.30 | 1.30 | 1.25 | 1.10 |
| Drying Time - Min. | 2.60 | 2.60 | 2.50 | 2.20 |
| Filtrate Volume - cc | 1690 | 1550 | 1460 | 920 |
| Wet Cake - Wt. - Gms. | 337 | 453.8 | 608.7 | 994 |
| Dry Cake - Wt. - Gms. | 192.8 | 280.6 | 382.4 | 600 |
| % Moisture in Cake | 42.8 | 38.2 | 37.2 | 39.6 |
| Total Cycle - Min.* | 5.20 | 5.20 | 5.00 | 4.40 |
| Lbs. Dry Cake/ Sq. Ft./Cycle | 0.85 | 1.23 | 1.68 | 2.64 |
| Lbs. Dry Cake/ Sq. Ft./Hr. | 9.8 | 14.1 | 20.2 | 36.0 |

*all tests were made using a 0.5 sq. ft. Denver filter at room temperature under a vacuum of 22-23 in. of mercury.

As shown by Table I, increasing the percentage of coal solids from 9.5 to 31.3 resulted in only a 15% decrease in forming time (0.20 min.) for a 2000 c.c. feed volume. However the weight of dry coal isolated from the thickened feed during that shortened time was over three times that isolated from the lowest solids feed. As a result of these two co-operating improvements in efficiency, the overall efficiency of the filtration step (expressed in weight of dry coal per square foot of filter per hour) was increased by approximately 370%.

It may thus be recognized by those skilled in the art that treating coal flotation froth products in accordance with the present invention will result in significant increase in efficiency of the coal filtration process.

While a preferred arrangement and construction of thickening tank has been shown and described for use in the method of the invention, it should be understood that any comparable thickening apparatus may be used in which water can drain from the froth into a body of water below and a separation between the thickened froth, the water, and the underflow can be made prior to directing the thickened froth to a filtration step or other method of final dewatering.

I claim:

1. In a coal treatment process wherein raw coal fines of minus 65 mesh size are treated in a flotation process followed by filtration of the resultant flotation froth product containing water, coal particles and froth bubbles to isolate a fine coal product, the improvement comprising:

(a) collecting the flotation froth product prior to filtration, (b) treating the collected flotation froth product in a thickening apparatus containing a sufficient body of aqueous liquid to physically decompose a portion of the froth and yield (1) a thickened froth which floats upon the surface of the body of aqueous liquid, (2) a coal containing aqueous liquid stream removed from a point between the surface of the aqueous liquid and the bottom of the thickening apparatus and (3) an underflow of a slurry of minus 65 mesh coal particles which sink to and are removed from the bottom of the thickening apparatus, (c) removing the thickened flotation froth from the thickening apparatus, and (d) filtering the thickened flotation froth to yield minus 65 mesh coal fines.

2. The coal treatment process of claim 1 additionally comprising:

(a) collecting the underflow or slurried minus 65 mesh coal particles which are removed from the bottom of the thickening apparatus, and (b) combining said collected coal particles with said thickened flotation froth prior to filtration in step (d).

3. The coal treatment process of claim 2 further comprising:

(a) removing the coal containing aqueous liquid stream taken from the thickening apparatus at a point beneath the flotation froth floating on the surface of the aqueous liquid and above the bottom of the thickening apparatus, and (b) returning said aqueous liquid stream to the prior flotation process for removal of minus 65 mesh coal particles suspended in the aqueous liquid.

4. A method for recovering fine coal particles of minus 65 mesh and less from a froth-product containing water obtained in a froth-flotation type fine coal treatment system, comprising:

(a) charging a froth-product containing coal fines of 65 mesh and less attached to bubbles within the froth into a thickener apparatus which uses an aqueous liquid body contained within the apparatus as a treatment and separation medium, (b) floating said froth-product upon the surface of said aqueous liquid for a time sufficient to dewater the froth-product and increase the solids content to thereby form a thickened froth-product, (c) skimming the thickened froth-product from atop said aqueous liquid in said thickener into a peripheral launder associated with said thickener, (d) passing said thickened froth-product from said launder to a filtration step, (e) filtering said thickened froth-product to separate said particles of coal from said water, and (f) removing said particles of minus 65 mesh coal as a filter cake and recycling said water to the froth-flotation treatment system.

* * * * *

UNITED STATES PATENT AND TRADEMARK OFFICE

CERTIFICATE OF CORRECTION

PATENT NO. : 4,244,813

DATED : January 13, 1981

INVENTOR(S) : William H. Moyer, Jr.

It is certified that error appears in the above—identified patent and that said Letters Patent is hereby corrected as shown below:

Column 2, line 39, "various" should read -- previous --.

Column 3, line 31, "percentages" should read -- percentage --.

Column 7, line 29, "tpo" should read -- to --.

Column 7, line 46, "tak" should read -- tank --.

Column 8, line 7, "sleeve" should read -- sleeves --.

Signed and Sealed this

*Twelfth* Day of *May 1981*

[SEAL]

*Attest:*

RENE D. TEGTMEYER

*Attesting Officer*

*Acting Commissioner of Patents and Trademarks*